United States Patent [19]

Goodin

[11] 4,193,870

[45] Mar. 18, 1980

[54] POOL CLEANING SYSTEM AND APPARATUS

[76] Inventor: Raymon L. Goodin, 2227 W. Overton, Tucson, Ariz. 85704

[21] Appl. No.: 960,827

[22] Filed: Nov. 15, 1978

[51] Int. Cl.[2] ..... B01D 37/00

[52] U.S. Cl. ..... 210/65; 4/172.17; 60/413; 134/168 R; 210/70; 210/169

[58] Field of Search ..... 4/172, 172.17; 60/363, 60/413, 415; 134/167 R, 168 R; 210/65, 70, 169

[56] References Cited

U.S. PATENT DOCUMENTS

| | | | |
|---|---|---|---|
| 3,433,014 | 3/1969 | Duport et al. | 60/415 |
| 3,675,252 | 7/1972 | Ghiz | 4/172.17 |
| 4,114,206 | 9/1978 | Franc | 134/167 R |

*Primary Examiner*—Charles N. Hart
*Assistant Examiner*—Richard W. Burks
*Attorney, Agent, or Firm*—Warren F. B. Lindsley

[57] ABSTRACT

Apparatus for cleaning a swimming pool wherein one or more automatically controlled water jets are strategically spaced about the floor of the pool, their periodic operation and their direction being controlled by air-actuated means in a manner which optimizes their effectiveness.

8 Claims, 9 Drawing Figures

POOL CLEANING SYSTEM AND APPARATUS

BACKGROUND OF THE INVENTION

This invention relates to swimming pools and more particularly to automatic cleaning methods and apparatus which employ one or more jet streams of water originating at or near the interior surface of the pool to agitate dirt that has settled to the floor of the pool so that it may become suspended in the pool water and be pumped through the pool water filtering apparatus.

Existing automatic pool sweeping systems employ powerful water jets projected from sweeper hoses at the bottom of the pool to dislodge dirt and keep the water agitated until the dirt finds its way into the pool outlets.

Recently water outlet heads mounted in the pool side walls and bottom have produced jet streams that are rotated 360 degrees to help agitate and clean the pool water. These outlet heads employ complicated mechanisms to rotate the jet streams.

DESCRIPTION OF THE PRIOR ART

Existing automatic pool cleaning apparatus and methods employing jet streams of liquid to dislodge particles of dirt from the interior surface of the pool have been only partially effective.

U.S. Pat. No. 3,045,829 employs fixed jets, but the number of jets required to clean a pool is so great that a booster pump is necessary. Also, fixed jets stain the interior surface of the pool after a given period of time. The reason for staining is that the pool water normally contains dissolved substances such as copper sulfate, iron oxides, and acids used to purify the water. When these substances are directed over the pool surface for a long period of time, a fan shaped stain will result.

U.S. Pat. No. 3,247,968 employs rotating jets. They either rotate too fast to be efficient or stop and do not rotate at all. Such rotating jet arrangements have the disadvantage that the torque applied to the nozzle when sufficient to overcome the friction of the rotating nozzle at its bearing surface and the friction encountered when rotating through the water will be so great that an undesirable speed of rotation is necessary. Such a high rotational speed of the jets is undesirable since the jet stream is not permitted to achieve a maximum velocity in any one direction and the resulting spiral path is characterized by low velocity and ineffective cleaning action.

U.S. Pat. No. 3,506,489 employs jet streams of liquid that turn off and on in a fixed time relationship. One of the disadvantages of this is that the part of the pool that is not being cleaned is a dead sport and dirt that was suspended in the pool liquid is allowed to settle back to the pool floor. Another disadvantage is that when a jet stream of liquid is turned into a pool it takes several minutes for it to reach out to its full length. Thus, when a jet is turned off and then on again, it is far less efficient in the sweeping of a pool floor than a jet that is sustained continuously.

Other prior art means have been described for causing slow or intermittent rotation of jets in automatic pool cleaning systems. U.S. Pat. No. 3,449,772, for example, describes a jet head incorporating a stainless steel ball which is circulated inside the housing by swirling water. The impact of the ball with a projecting boss incrementally rotates the head. The amount or speed of rotation in this arrangement, however, is highly dependent upon friction and water pressure, both of which are variable with time. U.S. Pat. No. 3,675,252 covers a rotating jet arrangement that utilizes a water turbine coupled to the jet head by a speed reduction gear train to turn the head at low speed. The water supplied to be delivered by the jet also turns the turbine which rotates the head. The disadvantages of this arrangement are the dependence of rotational velocity on pump pressure and the loss in jet pressure contributed by turbine operation.

What is needed is an automatic means for periodically and reliably adjusting the jet direction in small increments, thereby permitting the jet stream to maintain a fixed direction for a sufficiently long period of time to maintain maximum length and velocity. In such a system the available pressure to the jets should not be reduced by energy demands of the jet rotating means. A maximum area may thus be served by a single jet while achieving an optimum cleaning action.

SUMMARY OF THE INVENTION

The present invention overcomes the disadvantages and deficiencies of the prior art apparatus. A unique method and apparatus employed in the invention utilizes air-actuated mechanisms to rotate the several jets positioned about the floor of the pool. Rotational increments of a very few degrees are effected at periodic intervals to step the jets slowly through a full 360 degrees of rotation. Between the stepping intervals the jets remain stationary so that maximum length and velocity are achieved.

It is therefore one object of this invention to provide an improved system and apparatus for automatically cleaning a swimming pool.

Another object of this invention is to provide a pool cleaning system which utilizes one or more water jets positioned strategically about the floor of the pool where they can be directed along the floor surface to stir up dirt and debris which has settled there so that it may become suspended and carried away by the filtration system.

A further object of this invention is to provide such a system in which the jet heads may be stepped automatically in very small increments at periodic intervals so that over a period of time they will be rotated a full 360 degrees.

A still further object of this invention is to provide such a system in which the period of time through which the jet position remains fixed between incremental adjustments is sufficiently long to permit the water jet to reach its full length and maximum velocity, as needed for maximum cleaning effectiveness.

A still further object of this invention is to provide such a system in which the rate of jet advancement or rotation is independent of the pressure available from the filter pump.

A still further object of this invention is to provide such a system in which the pressure available for circulation of water through the jets is not diminished by the energy expanded to rotate the jets.

A still further object of this invention is to provide in such a system a capability for periodically switching the flow of water from one group of jet heads to another group of jet heads, and thereby to concentrate available water flow in specific areas as needed to provide an effective cleaning action.

A still further object of this invention is to provide such a system in which the associated apparatus is totally controlled by air and water pressure.

Yet another object of this invention is to provide the associated apparatus in a form which utilizes no fast-moving parts so that a high degree of reliability and a long operating life may be achieved for the system.

Further objects and advantages of the invention will become apparent as the following description proceeds, and the features of novelty which characterize the invention will be pointed out with particularity in the claims annexed to and forming a part of this specification.

BRIEF DESCRIPTION OF THE DRAWING

The present invention may be more readily described with reference to the accompanying drawing, in which.

DESCRIPTION OF THE PREFERRED EMBODIMENT

Figure 1:
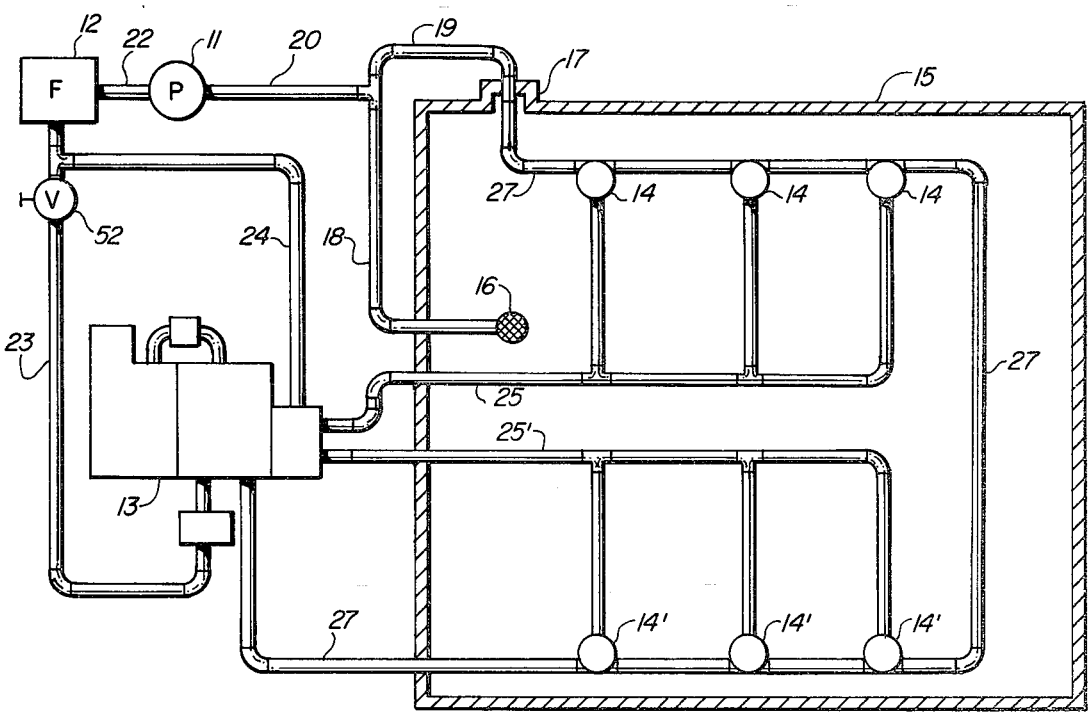
FIG. 1 is a diagram of a swimming pool cleaning system incorporating the pool cleaning apparatus of the invention.

Referring more particularly to the drawing by characters of reference, FIG. 1 discloses an automatic swimming pool cleaning system 10 comprising a pump 11, a filter 12, an air-actuated control mechanism 13 and jet delivery heads 14 and 14'. The system 10 is shown installed in a swimming pool 15 which has a drain 16 and a skimmer 17.

The pool 15 is of typical construction and arrangement in which the drain is centrally located in the deepest area of the pool and the skimmer 17 is located at the water surface at one edge of the pool. The jet heads replace or supplement the usual pool inlet ports through which water is ordinarily returned to the pool from the filter 12.

The minimum complement of cleaning equipment ordinarily provided with a home swimming pool includes the pump 11 and the filter 12. In such a minimum cleaning system the pump draws water from the skimmer 17 and from the drain 16 and sends it through the filter 12 and back into the pool through the pool inlet ports. Surface debris from the skimmer 17 and settled debris from the drain 16 are retained in a screen or in the filter 12.

In the improved system 10 the drain 16 and the skimmer 17 are connected by water lines 18 and 19, respectively, to a common line 20 which is connected to the inlet of pump 11. The outlet of pump 11 is connected by a water line 22 to the inlet of filter 12. The outlet of filter 12 is connected by two water lines 23 and 24 to two separate inlet ports of mechanism 13. Mechanism 13 supplies water to heads 14 through delivery line 25 and to heads 14' through delivery line 25'. The rotation of jet delivery heads 14 and 14' is actuated by means of a single water line 27 which originates at mechanism 13, passes serially through actuating vanes in all of the heads 14 and 14' and terminates at the pool skimmer 17.

Mechanism 13 comprises an air chamber 28, a water-pumping chamber 29, a valve chamber 31, an air compressor 32, a pressure-operated control valve 33 and a check valve 34. Chambers 28, 29 and 31 are rectangular chambers positioned adjacent each other and they share a common outer shell. Chambers 28 and 29 are approximately equal in size; chamber 31 is somewhat smaller. Compressor 32 has its outlet connected by an air line 35 to chamber 28. Valve 33 has its inlet connected by line 36 to chamber 28 and its outlet is connected by line 37 to the top of chamber 29. Check valve 34 is serially connected in line 23 between filter 12 and a water inlet port 38 at the bottom of chamber 29. Line 24 from filter 12 entering the top of chamber 31 and line 27 is connected to the bottom of chamber 29. Lines 25 and 25' enter chamber 31 through an outside vertical wall 39 in a manner to be discussed further in connection with the description of chamber 31.

Chambers 28 and 29 are separated by a common wall 41 and chambers 29 and 31 are separated by a common wall 42. Walls 41, 42 and 39 are mutually parallel.

Figure 2:
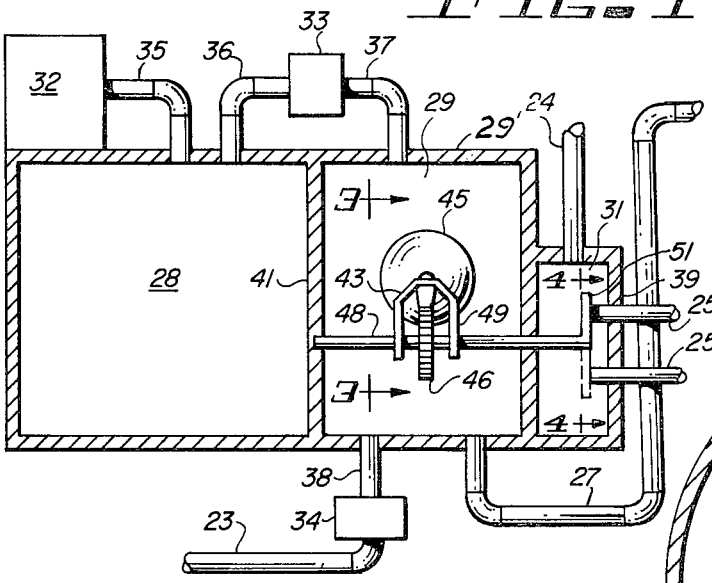
FIG. 2 is a cross-sectional view of an air-actuated control mechanism incorporated in the system of FIG. 1.
Figure 4:
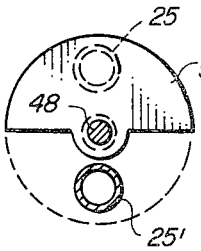
FIG. 4 is an end view of the valve plate incorporated in the mechanism of FIG. 2 as viewed along line 4—4.
Figure 3:
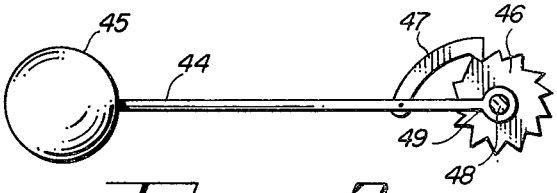
FIG. 3 is a side view of an actuator incorporated in the mechanism of FIG. 2 as viewed along line 3—3.

Chamber 29 houses an actuator 43 which is shown in both FIG. 2 and FIG. 3. Actuator 43 comprises a reciprocating lever 44 having a float 45 attached at one end, a ratchet wheel 46 rotationally mounted at the opposite end, and a pawl 47 pivotally attached to lever 44 at a point near the wheel 46 in a manner which permits its free end to engage the teeth of wheel 46. Wheel 46 is rigidly attached to an axle 48 and axle 48 passes rotationally through the ends of a wishbone 49 formed at the end of lever 44 which carries wheel 46. Axle 48 is perpendicularly oriented with respect to walls 41 and 42. It is rotationally mounted at one end to wall 41 and it passes rotationally through a circular bore in wall 42 into chamber 31. At the end of axle 48 which terminates in chamber 31 is attached a cam or flat semicircular plate 51. Plate 51 is perpendicularly attached to the end of axle 48, the point of attachment to plate 51 being located at the center of the straight side of its semi-circular configuration. As shown in FIGS. 2 and 4, lines 25 and 25' are mutually parallel with axle 48 and their terminations inside chamber 31 coincide with a plane that lies at a clearance distance to the right of the right-hand surface of plate 51. Lines 25 and 25' also lie in a common plane with axle 48, and are diametrically opposite each other relative to axle 48. The separation between axle 48 and either of the lines 25 and 25' is somewhat less than the radius of plate 51 so that as plate 51 is rotated by axle 48 it alternately covers the end of line 25 or 25', one at a time, blocking the flow of water to one line, then to the other, etc.

Compressor 32 is capable of delivering approximately one-half cubic foot of air per minute at a pressure approaching fifty pounds per square inch.

In the operation of mechanism 13, valve 33 is initially closed, water has been drained from chamber 29, float 45 rests at or near the floor of chamber 29, and pawl 47 is engaged with wheel 46. Compressor 32 begins pumping air into chamber 28 and chamber 29 begins to fill with water entering at port 38. A low rate of water flow into line 23 accompanies the rise of water in chamber 29, the low rate being intentionally controlled by the adjustment of a valve 52 serially connected in line 23 as shown in FIG. 1. As the operating cycle progresses, the air pressure rises in chamber 28 through the action of compressor 32, and the rising water in chamber 29 causes float 45 to rise, carrying with it the end of lever 44 so that wheel 46, axle 48 and plate 51 are rotated through an angle proportional to the rise in the water level. At some level of pressure reached in chamber 28, valve 33 opens and compressed air rushes from chamber 28 through line 36, valve 33 and line 37 into the top of chamber 29. The rush of air into chamber 29 forces the water from chamber 29 through line 27 and the exhausted body of water from chamber 29 flows successively through the serially connected jet heads 14' and 14, finally leaving line 27 at its open end and exhausting into the skimmer 17. The emptying of water from line 27 is followed by a quantity of air which also exits at skimmer 17. The termination of line 27 at or near the water surface in skimmer 17 prevents the exhausting air from creating an objectionably loud sound as would accompany its release at a greater depth. As valve 33 opens to initiate the rush of water from chamber 29, check valve 34 closes to prevent a reverse flow of water through line 23 into filter 12. As the water is driven from chamber 29, float 45 falls to the floor of chamber 29 with pawl 47 disengaged from wheel 46.

At the end of the cycle just described, the reduced pressure in chamber 28 causes valve 33 to close and another operating cycle ensues. Each successive operating cycle produces a small incremental rotation of plate 51 and delivers a burst of water through line 27.

As plate 51 is thus incrementally turned about its axis water flow from filter 12 and line 24 is periodically shifted from line 25 to line 25', then back to line 25, etc. to be delivered either to jet heads 14 or 14'. Each burst of water through line 27 produces a small incremental rotation of each of the jet delivery heads, 14 and 14'.

Figure 6:
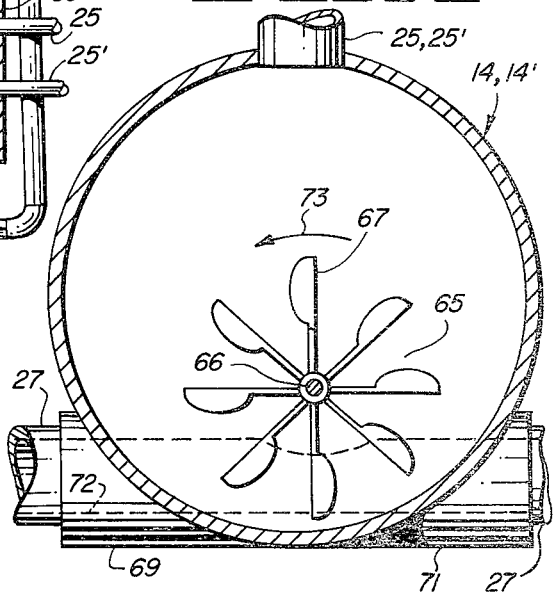
FIG. 6 is a cross-sectional bottom view of the jet delivery head of FIG. 5 as viewed along line 6—6.
Figure 5:
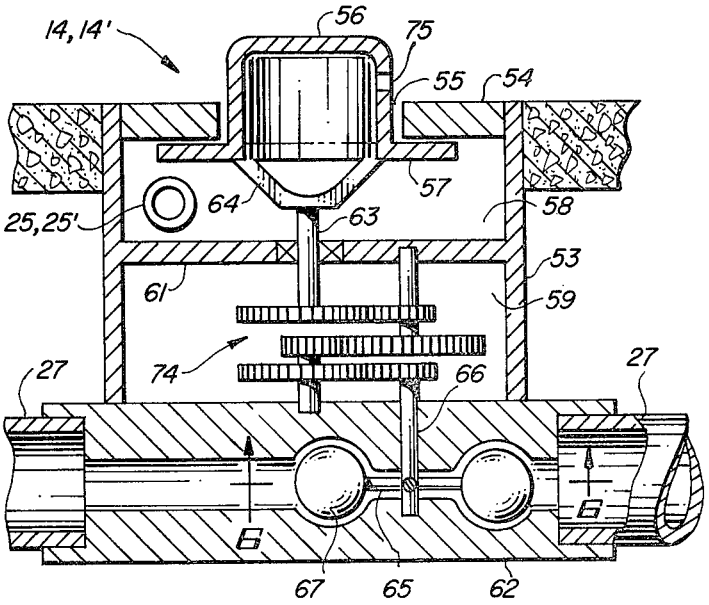
FIG. 5 is a cross-sectional side view of a jet delivery head incorporated in the system of FIG. 1.

FIGS. 5 and 6 show the jet delivery head, 14, 14' comprising a roughly cylindrical housing 53 having its axis vertically oriented. The top of housing 53 is closed by a circular cover 54 having a circular center opening 55. A cylindrical jet nozzle 56 protrudes upward through opening 55, its upward travel being limited by a rim or collar 57. Housing 53 encloses an upper chamber 58 and a lower chamber 59 separated by a horizontal plate 61. Attached to the underside of housing 53 is a turbine assembly 62. Nozzle 56 is supported by an axial shaft 63 which passes vertically downward through plate 61 to a pivotal mounting in the top surface of turbine assembly 62. Shaft 63 is attached to nozzle 56 by a flexible coupling 64 which permits nozzle 56 to retract into chamber 58 if external force is applied.

Turbine assembly 62 incorporates a turbine wheel which may utilize a paddle wheel or other similar configuration such as the cupped wheel 65. Wheel 65 is perpendicularly attached at its axis to a shaft 66 which passes vertically upward through a rotational clearance hole in assembly 62, through chamber 59 to a rotational bearing mount in plate 61. The cup-shaped paddles 67 rotate about shaft 66 in an annular channel 68 which is in communication with line 27 through intake and exhaust ports 69 and 71, respectively. Water entering port 69 follows a path outlined by broken lines 72, flowing past one side of wheel 65 impinging against the concave surfaces of the paddles 67 at that side of the wheel and producing thereby a counterclockwise rotation 73 as shown in FIG. 6. Shaft 66 is coupled by a speed reduction gear 74 to shaft 63 so that a rapid rotation of wheel 65 and shaft 66 produces a very slow rotation of shaft 63 and nozzle 56, and a relatively large number of rotations of wheel 65 may produce only a small angular displacement such as one or two degrees of nozzle 56.

Nozzle 56 has an opening 75 which extends horizontally through its cylindrical wall at a point just above the upper surface of cover 54. Water which enters chamber 58 from line 25 or 25' flows upward through the open lower end of nozzle 56 and horizontally outward through opening 75 so that it sweeps across the floor of the pool in a direction controlled by the instantaneous angular position of the nozzle 56.

It should be noted that pipe 27 rises above the top of housing 29' forming chamber 29 in FIG. 2 so a trap is formed and no water will flow out of chamber 29 until the air therein is released. An incremental rather than a continuous rotation of the jets 56 is thus achieved, with the result that the jet direction remains stationary for a relatively long period of time between the incremental directional adjustments. Ample time is thus allowed for the jet to achieve its maximum velocity and extended length for optimum cleaning action.

The compressor 32 which is utilized in the preferred embodiment just described with reference to FIGS. 1–6 may be eliminated through the incorporation or substitution of the mechanisms or assemblies of FIGS. 7–9.

Figure 9:
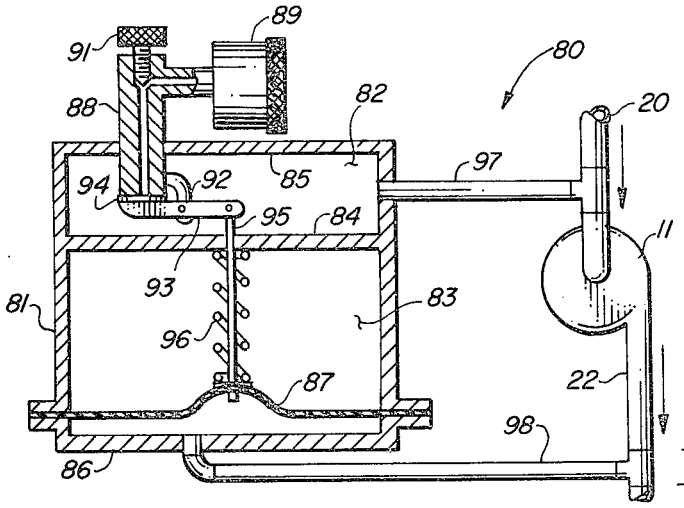
FIG. 9 is a cross-sectional view of an air-injection mechanism which may be utilized in the second embodiment of the invention.

FIG. 9 shows an air-injection mechanism 80 contained in a cylindrical housing 81 which is divided into an upper chamber 82 and a lower chamber 83 by a horizontal partition 84. The top of housing 81 is closed by a flat plate 85 and the lower flanged end is covered by a flanged plate or cover 86. A flexible diaphragm 87 is interposed between the flanged connection of cover 86 to housing 81 forming a water-tight and air-tight barrier between chamber 83 and the underside of diaphragm 87. An air inlet line 88 enters chamber 82 through plate 85. Air enters line 88 through an air filter 89 and its flow rate is adjustable by means of a screw 91. A pivoting valve assembly 92 is attached to the lower end of line 88, the assembly 92 comprising a lever 93 pivotally mounted at its center to line 88, its one end holding a stopper 94 under the open end of line 88 and its other end pivotally attached to the upper end of a vertical rod 95. Rod 95 passes downward through partition 84 and attached to the center of diaphragm 87. A compression spring 96 surrounding rod 95 urges diaphragm 87 and attached rod 95 downward tending to pivot stopper 94 upward against the open lower end of line 88 to block the entry of air into chamber 82.

A hollow tube 97 connects the interior of chamber 82 with the intake line 20 of the pump 11, and a tube 98 connects the outlet line 22 of pump 11 to the space between the lower side of diaphragm 87 and cover 86.

In the operation of mechanism 80, when the pump 11 is operating, the elevated pressure in outlet line 22 is transmitted to the underside of diaphragm 87 through tube 98 causing diaphragm 87 to be deflected upward, thereby operating valve assembly 92 to open line 88 and admit air into chamber 82. The reduced pressure produced by pump 11 in line 20 draws air from chamber 82 into line 20 and pump 11 mixing it with the water that is dispatched to filter 12 of FIGS. 1 and 7 through line 22.

Figure 7:
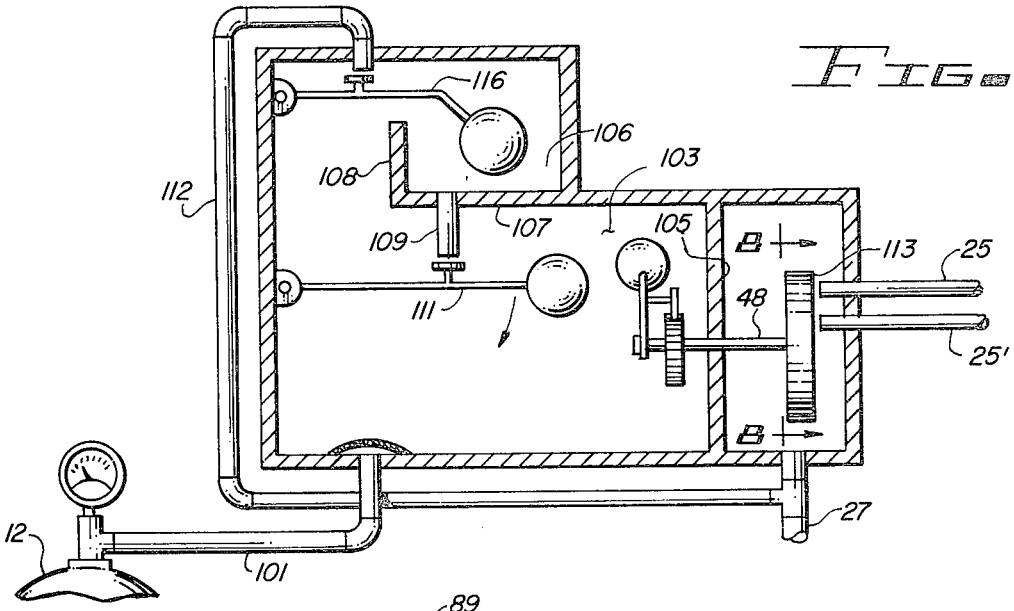
FIG. 7 is a cross-sectional view of an air-actuated mechanism which may be substituted for the mechanism of FIG. 2 in a second embodiment of the invention.

In filter 12 the entrained air rises to the top and finds its way through a connected line 101 into the air actuated mechanism 102 of FIG. 7.

Mechamism 102 has a pumping chamber 103 and a valve chamber 104 separated by a vertical wall 105.

Chamber 103 has an upper reservoir 106 formed by a shelf 107 which turns upward at one end to form a vertical wall 108. An opening between wall 108 and the outer wall of chamber 103 provides a path for the flow of air or water between reservoir 106 and the main lower portion of chamber 103. A hollow tube 109 opening into reservoir 106 through shelf 107 extends downward therefrom, its open lower end being guarded by a float valve 111 which closes tube 109 when the water level in chamber 103 is sufficiently high and opens tube 109 at lower water levels.

Figure 8:
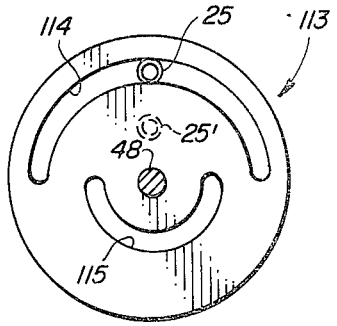
FIG. 8 is a side view of a valve plate incorporated in the mechanism of FIG. 7 as viewed along line 8—8 of FIG. 7.

A line 112 opening into the top wall of chamber 103 is connected to line 27 which is the same line 27 as shown in FIG. 1 and which in the embodiment of FIGS. 7–9 also opens into the valve chamber 104 of mechamism 102.

Valve chamber 104 is similar functionally and in its construction to chamber 31 of FIG. 2. An identical construction could be employed but the alternate construction shown here incorporates a variation in the design of the cam or plate identified in this case as cam 113. Instead of the semi-circular plate of FIG. 4 a circular plate is employed with two slotted openings, 114 and 115. Slot 114 lies along the circumference of a circle centered at axle 48 but having a diameter slightly less than that of cam 113. Slot 115 is also circular, centered on axle 48 but with a somewhat smaller diameter than that associated wth slot 114. The slots 114 and 115 cover 180 degrees each and are positioned on opposite sides of axle 48. The two lines 25 and 25' are in this case positioned on the same side of axle 48, one directly above the other. Again the rotation of cam 113 alternately opens one or the other of the lines 25 and 25' to deliver water to jet delivery heads 14 or 14'.

A float operated valve 116 mounted under the entry of line 112 into chamber 103 blocks the opening into line 112 when reservoir 106 is filled with water and opens the entry to line 112 when reservoir 106 is empty or only partially filled.

In the operation of mechanism 102, air accumulated at the top of filter 12 through the action of mechanism 80 of FIG. 9 flows through line 101 into chamber 103 which had been filled with water. Initially the water in chamber 103 holds both valves 111 and 116 closed. As the air rises through line 101 the displaced water flows downward through line 101 into filter 12. Water is retained in reservoir 106 until the level in chamber 103 falls low enough to open valve 111. When valve 111 opens the water drains from reservoir 106 through tube 109 and valve 116 opens. The accumulated air inside chamber 103 at high pressure is now released through line 112 to produce the burst of water flow through line 27 described earlier in connection with the first embodiment of the invention, the burst of water again incrementally rotating the jet delivery heads 14 and 14' of FIG. 1.

An effective automatic pool cleaning system and apparatus are thus provided in accordance with the stated objects of the invention and although but two embodiments of the invention have been illustrated and described, it will be apparent to those skilled in the art that various changes and modifications may be made therein without departing from the spirit of the invention or from the scope of the appended claims.

What is claimed is:

1. A pool cleaning apparatus comprising:

nozzle means mounted in the surfacce of a pool for ejecting recirculating pool water therethrough, said nozzle means comprising two groups of rotating heads, each of said rotating heads having an outlet port through which a stream of recirculating pool water is ejected, a first means for accumulating air at a given point in at least a part of the recirculating pool water and periodically ejecting this air into said part of the water to increase its flow rate, a second means for periodically rotating a given amount said nozzle means, and a third means connected to said nozzle means and periodically actuated by the increased flow rate of said part of said water for periodically rotating said nozzle means, said first means comprising selection means for sequentially selecting a different one of said groups for receiving a second part of the recirculating pool water each time said first means periodically ejects air into said first part.

2. The pool cleaning apparatus set forth in claim 1 wherein:

said second means comprises a turbine wheel.

3. The pool cleaning apparatus set forth in claim 2 wherein:

said second means further comprises a reduction gear interconnecting said nozzle means and said turbine wheel.

4. The pool cleaning apparatus set forth in claim 1 wherein:

said first means for accumulating air in the recirculating pool water comprises an air injecting means.

5. The pool cleaning apparatus set forth in claim 1 wherein:

said first means after accumulating a given amount of air at a point in the path of the recirculating water ejecting the air into said part of the recirculating water to actuate said selection means.

6. A method for circulating and cleaning water in a swimming pool comprising the steps of:

pumping water out of a drain of the swimming pool, filtering said water and subsequently pumping a first part of said water back into the swimming pool through rotatable jet nozzle means producing jet streams, periodically introducing air into a second part of the water pumped back into said swimming pool to periodically increase its flow rate, and rotating said jet nozzle means by said second part of the water during the period of its increased flow rate.

7. The method set forth in claim 6 in further combination with the step of:

returning said second part of the water to the pool after actuation of said jet nozzle means without flowing through said nozzle means.

8. The method set forth in claim 6 wherein:

said nozzle means comprises two groups of rotating jet producing heads, and selecting sequentially each of said groups of heads periodically each time the flow rate of said second part of the water is increased for providing a path for said first part of the water pumped back to the pool to reach the pool.

* * * * *